US005183401A

United States Patent [19]

Dalla Betta et al.

[11] Patent Number: 5,183,401

[45] Date of Patent: Feb. 2, 1993

[54] TWO STAGE PROCESS FOR COMBUSTING FUEL MIXTURES

[75] Inventors: Ralph A. Dalla Betta, Mountain View, Calif.; Nobuyasu Ezawa, Koto, Japan; Kazunori Tsurumi, Fujisawa, Japan; James C. Schlatter, Sunnyvale; Sarento G. Nickolas, Livermore, both of Calif.

[73] Assignees: Catalytica, Inc., Mt. View, Calif.; Tanaka Kikinzoku Kogyo KK, Japan

[21] Appl. No.: 618,301

[22] Filed: Nov. 26, 1990

[51] Int. Cl.[5] ..... F23D 3/40

[52] U.S. Cl. ..... 431/7; 431/328; 60/723

[58] Field of Search ..... 431/2, 7, 328; 60/723; 502/339

[56] References Cited

U.S. PATENT DOCUMENTS

| | | | |
|---|---|---|---|
| 3,870,455 | 3/1975 | Hindin | 431/7 |
| 3,928,961 | 12/1975 | Pfefferle | 60/723 |
| 3,969,082 | 7/1976 | Cairns et al. | 23/288 |
| 3,970,435 | 7/1976 | Schultz et al. | 48/61 |
| 4,019,969 | 4/1977 | Golebiowski et al. | 204/26 |
| 4,088,435 | 5/1978 | Hinden et al. | 431/7 |
| 4,220,559 | 9/1980 | Polinski | 252/455 |
| 4,279,782 | 7/1981 | Chapman et al. | 252/465 |
| 4,331,631 | 5/1982 | Chapman et al. | 422/180 |
| 4,414,023 | 11/1983 | Aggen et al. | 75/124 |
| 4,711,872 | 12/1987 | Kato et al. | 502/328 |
| 4,731,989 | 3/1988 | Furuya et al. | 60/39.05 |
| 4,788,174 | 11/1988 | Arai | 502/324 |
| 4,793,797 | 12/1988 | Kato et al. | 431/7 |
| 4,870,824 | 10/1989 | Young et al. | 431/328 |
| 4,893,465 | 1/1990 | Farrauto et al. | 60/723 |

FOREIGN PATENT DOCUMENTS

| | | | |
|---|---|---|---|
| 198948 | 10/1986 | European Pat. Off. | 502/339 |
| 3539125 | 1/1987 | Fed. Rep. of Germany | 502/339 |
| 59-136140 | 8/1984 | Japan . | |
| 14938 | 1/1985 | Japan | 60/723 |
| 61-259013 | 11/1986 | Japan . | |
| 55319 | 3/1988 | Japan | 60/723 |

OTHER PUBLICATIONS

Pennline, Henry W., Richard R. Schehl, and William P. Haynes, *Operation of a Tube Wall Methanation Reactor*, Ind. Eng. Chem. Process Des. Dev.: vol. 18, No. 1, 1979.

L. Louis Hegedus, "Temperature Excursions in Catalytic Monoliths", *AIChE Journal*, Sep. 1975, vol. 21, No. 5, 849-853.

Kee et al., "The Chemkin Thermodynamic Data Base", *Sandia National Laboratory Report No. SAND87-8215*, 1987.

Kubaschewski et al., "Metallurgical Thermo-Chemistry", *International Series on Materials Science and Technology*, 5th Edition, vol. 24, 382.

Hayashi et al., "Performance Characteristics of Gas Turbine Combustion Catalyst Under High Pressure", *Gas Turbine Society of Japan*, 1990, 18-69, 55.

"Complete Oxidation of Methane Over Perovskite Oxides", Kajii et al., Catalysis Letters 1, (1988), 299-306.

"Preparation and Characterization of Large Surface Area $BaO \cdot 6Al_2O_3$", Machida et al., Bull. Chem. Soc. Jpn., 61, 3659-3665 (1988).

"High Temperature Catalytic Combustion Over Cation-Substituted Barium Hexaaluminates", Machida et al., Chemistry Letters, 767-770, 1987.

"Analytical Electron Microscope Analysis of the Formation of $BaO \cdot 6Al_2O_3$", Machida et al., J. Am. Ceram. Soc., 71 (12) 1142-1147 (1988).

"Effect of Additives on the Surface Area of Oxide Supports for Catalytic Combustion", J. Cat. 103, 385-393 (1987).

"Surface Areas and Catalytic Activities of Mn-Substituted Hexaaluminates with Various Cation Compositions in the Mirror Plane", Chem. Lett., 1461-1464, 1988.

*Primary Examiner*—Carroll B. Dority

*Attorney, Agent, or Firm*—Morrison & Foerster

[57] ABSTRACT

This invention is a comparatively high pressure combustion process having a two stages in which a fuel is stepwise combusted using specific catalysts and catalytic structures and, optionally, having a final homogeneous combustion zone. The choice of catalysts and the use of specific structures, including those employing integral heat exchange, results in an overall catalyst structure which is stable due to its comparatively low temperature. The product combustion gas is at a temperature suitable for use in a gas turbine, furnace, boiler, or the like, but has low $NO_x$ content.

27 Claims, 3 Drawing Sheets

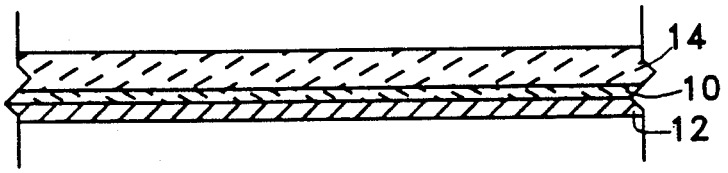
Fig. 2A
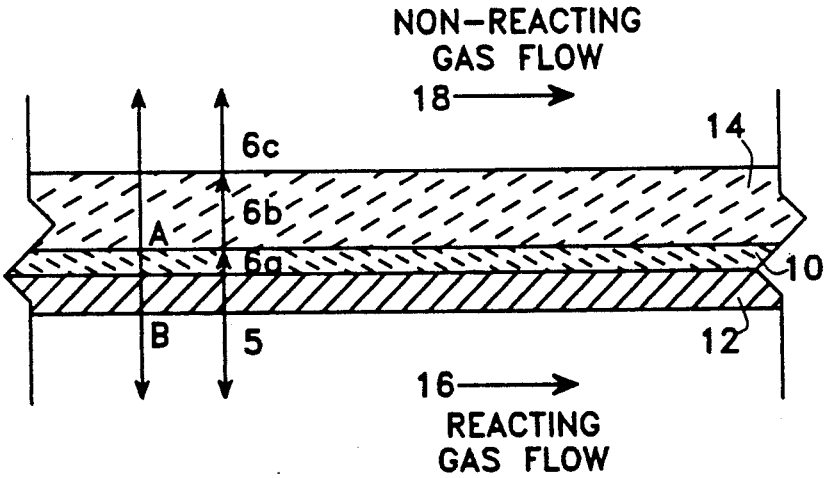
Fig. 2B
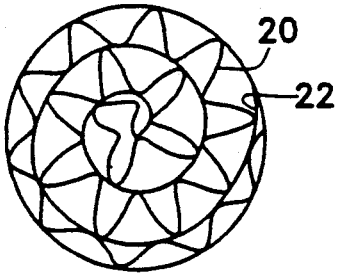
Fig. 3A
Fig. 3B
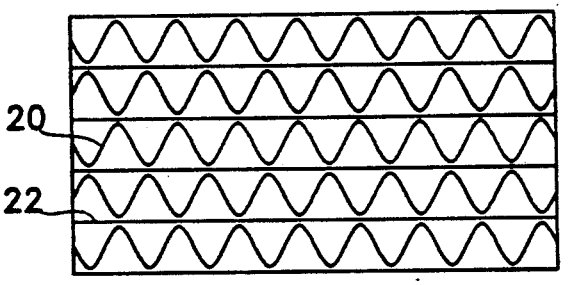
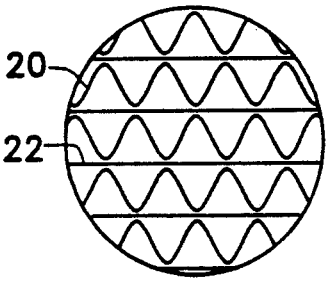
Fig. 3C

TWO STAGE PROCESS FOR COMBUSTING FUEL MIXTURES

FIELD OF THE INVENTION

This invention is a comparatively high pressure combustion process having a two stages in which a fuel is stepwise combusted using specific catalysts and catalytic structures and, optionally, having a final homogeneous combustion zone. The choice of catalysts and the use of specific structures, including those employing integral heat exchange, results in an overall catalyst structure which is stable due to its comparatively low temperature. The product combustion gas is at a temperature suitable for use in a gas turbine, furnace, boiler, or the like, but has low $NO_x$ content.

BACKGROUND OF THE INVENTION

With the advent of modern antipollution laws in the United States and around the world, significant and new methods of minimizing various pollutants are being investigated. The burning of fuel, be the fuel wood, coal, oils, or natural gas, likely causes a majority of the pollution problems in existence today. Certain pollutants such as $SO_2$, which are created as the result of the presence of a contaminant in the fuel source may be removed either by treating the fuel to remove the contaminant or by treating the exhaust gas eventually produced to remove the resulting pollutant. Other pollutants such as carbon monoxide, which are created as the result of incomplete combustion, may be removed by postcombustion oxidation or by improving the combustion process. The other principal pollutant, $NO_x$ (an equilibrium mixture mostly of NO, but also containing very minor amounts of $NO_2$), may be dealt with either by controlling the combustion process to minimize its production or by later removal. Removal of $NO_x$, once produced, is a difficult task because of its relative stability and its low concentrations in most exhaust gases. One ingenious solution used in automobiles is the use of carbon monoxide to reduce $NO_x$ to nitrogen while oxidizing the carbon monoxide to carbon dioxide. However, the need to react two pollutants also speaks to a conclusion that the initial combustion reaction was inefficient.

It must be observed that unlike the situation with sulfur pollutants where the sulfur contaminant may be removed from the fuel, removal of nitrogen from the air fed to the combustion process is an impractical solution. Unlike the situation with CO, improvement of the combustion reaction would likely increase the level of $NO_x$ produced due to the higher temperatures then involved.

Nevertheless, the challenge to reduce $NO_x$ remains and several different methods have been suggested. The process chosen must not substantially conflict with the goal for which the combustion gas was created, i.e., the recovery of its heat value in a turbine, boiler, or furnace.

Many recognize that a fruitful way to control $NO_x$ production is to limit the localized and bulk temperatures in the combustion zone to something less than 1800° C. See, for instance, U.S. Pat. No. 4,731,989 to Furuya et al. at column 1, lines 52–59 and U.S. Pat. No. 4,088,435 to Hindin et al. at column 12.

There are a number of ways to control the temperature, such as by dilution with excess air, controlled oxidation using one or more catalysts, or staged combustion using variously lean or rich fuel mixtures. Combinations of these methods are also known.

One widely attempted method is the use of multistage catalytic combustors. Most of these processes utilize multi-section catalysts with metal oxide or ceramic catalyst carriers. Typical of such disclosures are:

| Country | Document | 1st Stage | 2nd Stage | 3rd Stage |
|---|---|---|---|---|
| Japan | Kokai 60-205129 | Pt-group/$Al_2O_3$ & $SiO_2$ | La/$SiO_2$.$Al_2O_3$ | |
| Japan | Kokai 60-147243 | La & Pd & Pt/$Al_2O_3$ | ferrite/$Al_2O_3$ | |
| Japan | Kokai 60-66022 | Pd & Pt/$ZrO_2$ | Ni/$ZrO_2$ | |
| Japan | Kokai 60-60424 | Pd/— | CaO & $Al_2O_3$ & NiO & w/noble metal | |
| Japan | Kokai 60-51545 | Pd/* | Pt/* | $LaCoO_3$/* |
| Japan | Kokai 60-51543 | Pd/* | Pt/* | |
| Japan | Kokai 60-51544 | Pd/* | Pt/* | base metal oxide/* |
| Japan | Kokai 60-54736 | Pd/* | Pt or Pt—Rh or Ni base metal oxide or $LaCO_3$/* | |
| Japan | Kokai 60-202235 | $MoO_4$/— | $CoO_3$ & $ZrO_2$ & noble metal | |
| Japan | Kokai 60-200021 | Pd & $Al_2O_3$/+* | Pd & $Al_2O_3$/** | Pt/** |
| Japan | Kokai 60-147243 | noble metal/heat resistant carrier | ferrite/heat resistant carrier | |
| Japan | Kokai 60-60424 | La or Nd/$Al_2O_3$ 0.5% $SiO_2$ | Pd or Pt/NiO & $Al_2O_3$ & CaO 0.5% SiO | |
| Japan | Kokai 60-14938 | Pd/? | Pt/? | |
| Japan | Kokai 60-14939 | Pd & Pt/refractory | ? | ? |
| Japan | Kokai 61-252409 | Pd & Pt/*** | Pd & Ni/*** | Pd & Pt/*** |
| Japan | Kokai 62-080419 | Pd & Pt | Pd, Pt & NiO | Pt or Pt & Pd |
| Japan | Kokai 62-080420 | Pd & Pt & NiO | Pt | Pt & Pd |
| Japan | Kokai 63-080848 | Pt & Pd | Pd & Pt & NiO | Pt or Pt & Pd |
| Japan | Kokai 63-080849 | Pd, Pt, NiO/? | Pd & Pt (or NiO)/? | Pt or Pd & Pt/? |

*alumina or zirconia on mullite or cordierite
**Ce in first layer; one or more of Zr, Sr, Ba in second layer; at least one of La and Nd in third layer.
***monolithic support stabilized with lanthanide or alkaline earth metal oxide
Note: the catalysts in this Table are characterized as "a"/"b" where "a" is the active metal and "b" is the carrier The use of such ceramic or metal oxide supports is clearly well known. The structures formed do not readily melt or oxidize as would a metallic support. A ceramic support carefully designed for use in a particular temperature range can provide adequate service in that temperature range. Nevertheless, many such materials can undergo phase changes or react with other components of the catalyst system at temperatures above 1100° C., e.g., the gamma phase alumina changes to alpha phase alumina in that temperature region. In addition, such ceramic substrates are fragile, subject to cracking and failure as a result of vibration, mechanical shock, or thermal shock. Thermal shock is a particular problem in catalytic combustors used in gas turbines.

During startup and shutdown, large temperature gradients can develop in the catalyst leading to high mechanical stresses that result in cracking and fracture.

Typical of the efforts to improve the high temperature stability of the metal oxide or ceramic catalyst supports are the inclusion of an alkaline earth metal or lanthanide or additional metals into the support, often in combination with other physical treatment steps:

| Country | Document | Assignee or Inventor |
|---|---|---|
| Japan | Kokai 61-209044 | (Babcock-Hitachi KK) |
| Japan | Kokai 61-216734 | (Babcock-Hitachi KK) |
| Japan | Kokai 62-071535 | (Babcock-Hitachi KK) |
| Japan | Kokai 62-001454 | (Babcock-Hitachi KK) |
| Japan | Kokai 62-45343 | (Babcock-Hitachi KK) |
| Japan | Kokai 62-289237 | (Babcock-Hitachi KK) |
| Japan | Kokai 62-221445 | (Babcock-Hitachi KK) |
| U.S. | Pat. No. 4,793,797 | (Kato et al.) |
| U.S. | Pat. No. 4,220,559 | (Polinski et al.) |
| U.S. | Pat. No. 3,870,455 | (Hindin) |
| U.S. | Pat. No. 4,711,872 | (Kato et al.) |

However, even with the inclusion of such high temperature stability improvements, ceramics columnar catalyst with holes in the column walls to promote equal distribution of fuel gas and temperature amongst the columns lest cracks appear.

High temperatures (above 1100° C.) are also detrimental to the catalytic layer resulting in surface area loss, vaporization of metal catalysts, and reaction of catalytic components with the ceramic catalyst components to form less active or inactive substances.

Of the numerous catalysts disclosed in the combustion literature may be found the platinum group metals, platinum, palladium, ruthenium, iridium, and rhodium; sometimes alone, sometimes in mixtures with other members of the group, sometimes with non-platinum group promoters or co-catalysts.

Other combustion catalysts include metallic oxides, particularly Group VIII and Group I metal oxides. For instance, in an article by Kaiji et al, COMPLETE OXIDATION OF METHANE OVER PEROVSKITE OXIDES, Catalysis Letters I (1988) 299-306, J. C. Baltzer A. G. Scientific Publishing Co., the authors describe a set of perovskite oxide catalysts suitable for the oxidation of methane which are generically described as $ABO_3$, particularly oxides formulated as $La_{1-x}Me_xMnO_3$, where Me denotes Ca, Sr, or Ba.

Similarly, a number of articles by a group associated with Kyushu University described combustion catalysts based on $BaO.6Al_2O_3$:

1. PREPARATION AND CHARACTERIZATION OF LARGE SURFACE AREA $BaO.6Al_2O_3$, Machida et al, Bull. Chem. Soc. Jpn., 61,3659-3665 (1988),
2. HIGH TEMPERATURE CATALYTIC COMBUSTION OVER CATION-SUBSTITUTED BARIUM HEXAALUMINATES, Machida et al, Chemistry Letters, 767-770, 1987,
3. ANALYTICAL ELECTRON MICROSCOPE ANALYSIS OF THE FORMATION OF $BaO.6Al_2O_3$, Machida et al, J. Am. Ceram. Soc, 71 (12) 1142-47 (1988),
4. EFFECT OF ADDITIVES ON THE SURFACE AREA OF OXIDE SUPPORTS FOR CATALYTIC COMBUSTION, J. Cat. 103, 385-393 (1987), and
5. SURFACE AREAS AND CATALYTIC ACTIVITIES OF Mn-SUBSTITUTED HEXAALUMINATES WITH VARIOUS CATION COMPOSITIONS IN THE MIRROR PLANE, Chem. Lett., 1461-1464, 1988.

Similarly, U.S. Pat. No. 4,788,174, to Arai, suggests a heat resistant catalyst suitable for catalytic combustion having the formula $A_{1-x}C_xB_xAl_{12-y}O_{19-a}$, where A is at least one element selected from Ca, Ba, and Sr; C is K and/or Rb; B is at least one from Mn, Co, Fe, Ni, Cu, and Cr; z is a value in the range from 0-0.4; x is a value in the range of 0.1-4, y is a value in the range of about $x-2x$; a is a value determined by the valence X, Y, and Z of the respective element A, C, and B and the value of x, y, and z and it is expressed as $a=1.5\{X-z(X-Y)+xZ-3y\}$.

In addition to the strictly catalytic combustion processes, certain processes use a final step in which remaining combustibles are homogeneously combusted prior to recovering the heat from the gas.

A number of the three stage catalyst combination systems discussed above also have post-combustion steps. For instance, a series of Japanese Kokai assigned to Nippon Shokubai Kagaku (62-080419, 62-080420, 63-080847, 63-080848, and 63-080849) disclose three stages of catalytic combustion followed by a secondary combustion step. As was noted above, the catalysts used in these processes are quite different from the catalysts used in the inventive process. Additionally, these Kokai suggest that in the use of a post-combustion step, the resulting gas temperature is said to reach only "750° C. to 1100° C.". In clear contrast, the inventive process may be seen to reach substantially higher temperatures depending upon the makeup of the fuel/air mixture.

Other combustion catalyst/post-catalyst homogeneous combustion processes are known. European Patent Application 0,198,948 (also issued to NSK) shows a two or three stage catalytic process followed by a post-combustion step. The temperature of the post-combusted gas was said to reach 1300° C. with an outlet temperature from the catalyst (approximately the bulk gas phase temperature) of 900° C. The catalyst structures disclosed in the NSK Kokai are not, however, protected from the deleterious effects of the combustion taking place within the catalytic zones and consequently the supports will deteriorate.

The patent to Furuya et al. (U.S. Pat. No. 4,731,989) discloses a single stage catalyst with injection of additional fuel followed by post-catalyst combustion.

An aspect in the practice of our inventive process is the use of metal integral heat exchange structures in the latter catalytic stage or stages of the combustion. Generically, the concept is to position a catalyst layer on one surface of a wall in the catalytic structure which is opposite a surface having no catalyst. Both sides are in contact with the flowing fuel-gas mixture: on one side reactive heat is produced; on the other side that reactive heat is transferred to the flowing gas.

Structures having an integral heat exchange feature are shown in Japanese Kokai 59-136, 140 and 61-259,013. In addition to a number of other differences, the structures are disclosed to be used in isolation and not in conjunction with other catalyst stages. Additionally, the staged use of the structure with different catalytic metals is not shown in the two Kokai.

None of the processes in this discussion appear to show a combination two stage catalyst system in which the catalyst supports are metallic, in which the catalysts are specifically varied to utilize their particular benefits, in which integral heat exchange is selectively applied to control combustion temperature, and particularly, in which high gas temperatures are achieved while maintaining low $NO_x$ production and catalyst temperatures.

SUMMARY OF THE INVENTION

This invention is a two stage catalytic combustion process in which the fuel is premixed at a specific fuel-/air ratio to give a desired adiabatic combustion temperature, then reacted in a series of two catalyst structures and optionally in a homogeneous combustion zone. The combustion is staged so that catalyst and bulk gas temperatures are controlled through catalyst choice and structure. We have found that as the pressure of operation increases, the temperature at which the palladium catalyst "self-limits" rises and the temperature at which the fuel mixture undergoes homogeneous combustion decreases. At operation pressures above about four to five atmospheres, for most practical fuel/air ratios, the palladium catalyst self-limiting temperature and the homogeneous combustion initiation temperature are equal or are sufficiently compatible that a "hot end" combustion catalyst stage may be eliminated. The process produces an exhaust gas of a very low $NO_x$ concentration but at a temperature suitable for use in a gas turbine, boiler, or furnace.

BRIEF DESCRIPTION OF THE DRAWINGS

FIG. 2A and 2B show close-up, cutaway views of the catalyst and its support.

FIGS. 3A, 3B, 3C, 4A, 4B, 5, 6A, and 6B all show variations of the integral heat exchange catalyst structure which may be used in the catalytic stages of the inventive process.

DESCRIPTION OF THE INVENTION

Figure 1:
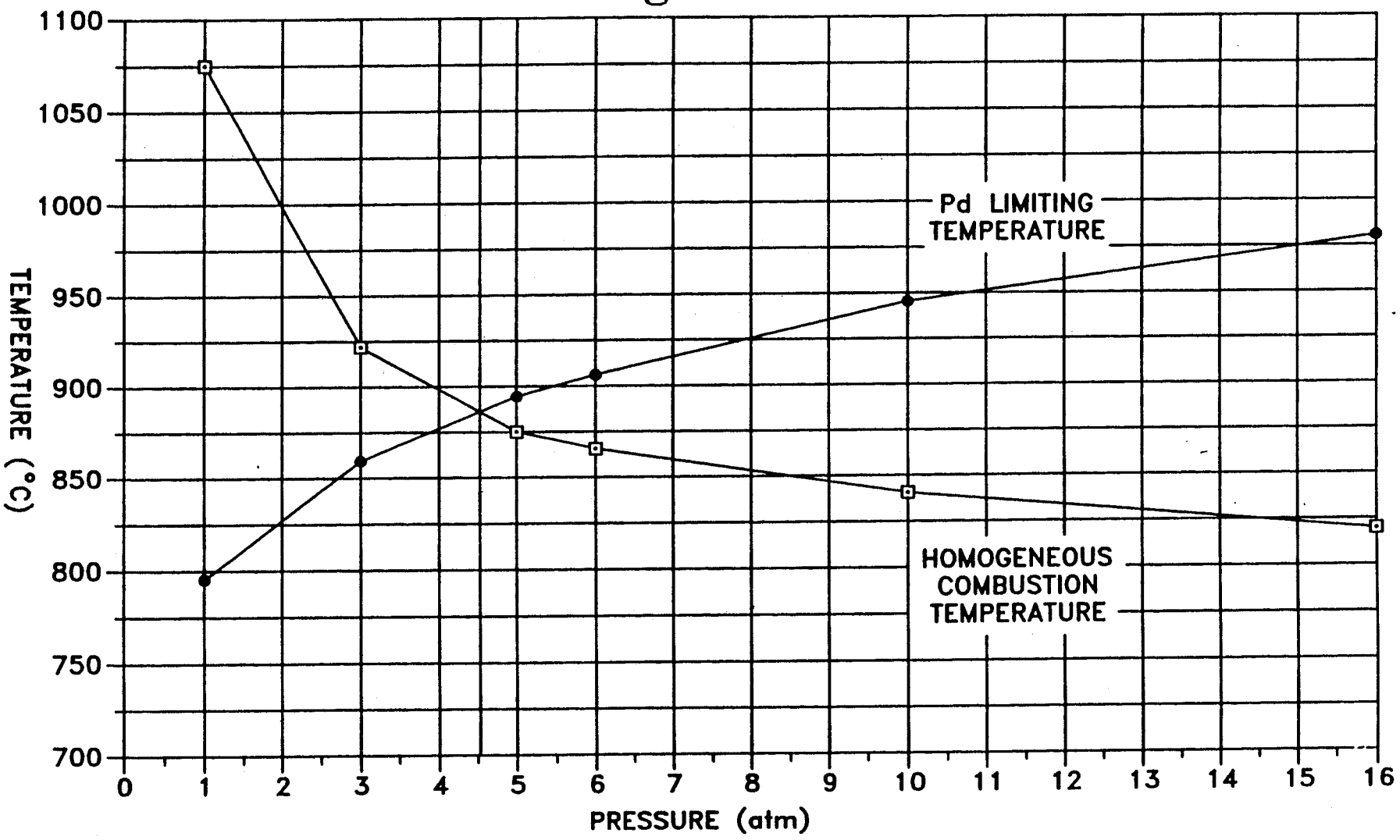
FIG. 1 is a graph showing the relationship among the palladium "limiting" temperature, homogeneous combustion temperature, and $O_2$ pressure.

This invention is a two stage catalytic combustion process in which the fuel is premixed at a specific fuel-/air ratio to give a desired adiabatic combustion temperature, then reacted in a series of two catalyst structures and optionally in a homogeneous combustion zone. The combustion is staged so that catalyst and bulk gas temperatures are controlled through catalyst choice and structure. As the pressure of operation increases, the temperature at which the palladium catalyst "self-limits" rises and the temperature at which the fuel mixture undergoes homogeneous combustion decreases. As is shown in FIG. 1, as the partial pressure of $O_2$ rises (be it through increase in overall pressure or increase in $O_2$ concentration), the theoretical temperature needed to complete homogeneous combustion (to a level of carbon monoxide less than 10 ppm) declines to a level where the palladium catalyst will initiate that combustion. The two lines meet between four to five atmospheres. When air is compressed to a level above four to five atmospheres, the homogeneous combustion reaction will go to completion within eleven milliseconds. At above about four to five atmospheres, for most practical fuel/air ratios, the palladium catalyst self-limiting temperature and the homogeneous combustion initiation temperature are equal or are sufficiently compatible that a third stage "hot end" combustion catalyst may be eliminated. The process produces an exhaust gas of a very low $NO_x$ concentration but at a temperature suitable for use in a gas turbine, boiler, or furnace.

This process may be used with a variety of fuels and at a broad range of process conditions.

Although normally gaseous hydrocarbons, e.g., methane, ethane, and propane, are highly desireable as a source of fuel for the process, most fuels capable of being vaporized at the process temperatures discussed below are suitable. For instance, the fuels may be liquid or gaseous at room temperature and pressure. Examples include the low molecular weight hydrocarbons mentioned above as well as butane, pentane, hexene, heptene, octane, gasoline, aromatic hydrocarbons such as benzene, toluene, ethylbenzene; and xylene; naphthas; diesel fuel, kerosene; jet fuels; other middle distillates; heavy distillate fuels (preferably hydrotreated to remove nitrogenous and sulfurous compounds); oxygen-containing fuels such as alcohols including methanol, ethanol, isopropanol, butanol, or the like; ethers such as diethylether, ethyl phenyl ether, MTBE, etc. Low-BTU gases such as town gas or syngas may also be used as fuels.

The fuel is typically mixed into the combustion air in an amount to produce a mixture having a theoretical adiabatic combustion temperature greater than the catalyst or gas phase temperatures present in the catalysts employed in this inventive process. Preferably the adiabatic combustion temperature is above 900° C., and most preferably about 1000° C. Non-gaseous fuels should be vaporized prior to their contacting the initial catalyst zone. The combustion air may be compressed to a pressure of 500 psig. or more. Stationary gas turbines often operate at pressures in the vicinity of 150 psig.

First Catalytic Zone

The fuel/air mixture supplied to the first zone should be well mixed and heated to a temperature high enough to initiate reaction on the first zone catalyst; for a methane fuel on a typical palladium catalyst, a temperature of at least about 325° C. is usually adequate. This preheating may be achieved by partial combustion, use of a pilot burner, by heat exchange, or by compression.

The first zone in the process contains a catalytic amount of palladium on a monolithic catalyst support offering low resistance to gas flow. The support is preferably metallic. Palladium is very active at 325° C. and lower for methane oxidation and can "light off" or ignite fuels at low temperatures. It has also been observed that in certain instances, after palladium initiates the combustion reaction, the catalyst rises rapidly to temperatures of 750° C. to 800° C. at one atm of air or about 940° C. at ten atm total pressure of air. These temperatures are the respective temperatures of the transition points in the thermal gravimetric analysis (TGA) of the palladium/palladium oxide reaction shown below at the various noted pressures. At that point the catalytic reaction slows substantially and the catalyst temperature moderates at 750° C. to 800° C. or 940° C., depending on pressure. This phenomenon is observed even when the fuel/air ratio could produce theoretical adiabatic combustion temperatures above 900° C. or as high as 1700° C.

One explanation for this temperature limiting phenomenon is the conversion of palladium oxide to palladium metal at the TGA transition point discussed above. At temperatures below 750° C. at one atm of air, palladium is present mainly as palladium oxide. Palladium oxide appears to be the active catalyst for oxidation of fuels. Above 750° C., palladium oxide converts to palladium metal according to this equilibrium:

$$PdO \rightarrow Pd + \frac{1}{2}O_2$$

Palladium metal appears to be substantially less active for hydrocarbon combustion so that at temperatures above 750° C. to 800° C. the catalytic activity decreases appreciably. This transition causes the reaction to be self-limiting: the combustion process rapidly raises the catalyst temperature to 750° C. to 800° C. for homogeneous combustion where temperature self-regulation begins. This limiting temperature is dependent on $O_2$ pressure and will increase as the $O_2$ partial pressure increases.

Some care is necessary, however. The high activity of palladium can lead to "runaway" combustion where even the low activity of the palladium metal above 750° C. can be sufficient to cause the catalyst temperature to rise above 800° C. and even to reach the adiabatic combustion temperature of the fuel/air mixture as noted above; temperatures above 1100° C. can lead to severe deterioration of the catalyst. We have found that runaway combustion can be controlled by adding a diffusion barrier layer on top of the catalyst layer to limit the supply of fuel and/or oxidant to the catalyst. The diffusion layer greatly extends the operating range of the first stage catalyst to higher preheat temperatures, lower linear gas velocities, higher fuel/air ratio ranges, and higher outlet gas temperatures. We have also found that limiting the concentration of the palladium metal on the substrate will prevent "runaway" but at the cost of relatively shorter catalyst life.

This self-limiting phenomenon maintains the catalyst substrate temperature substantially below the adiabatic combustion temperature. This prevents or substantially decreases catalyst degradation due to high temperature operation.

The palladium metal is added in an amount sufficient to provide significant activity. The specific amount added depends on a number of requirements, e.g., economics, activity, life, contaminant presence, etc. The theoretical maximum amount is likely enough to cover the maximum amount of support without causing undue metal crystallite growth and concomitant loss of activity. These clearly are competing factors: maximum catalytic activity requires higher surface coverage, but higher surface coverage can promote growth between adjacent crystallites. Furthermore, the form of the catalyst support must be considered. If the support is used in a high space velocity environment, the catalyst loadings likely should be high to maintain sufficient conversion even though the residence time is low. Economics has as its general goal the use of the smallest amount of catalytic metal which will do the required task. Finally, the presence of contaminants in the fuel would mandate the use of higher catalyst loadings to offset the deterioration of the catalyst by deactivation.

The palladium metal content of this catalyst composite is typically quite small, e.g., from 0.1% to about 15% by weight, or from 0.01% to about 20% by weight. The catalyst may optionally contain up to an equivalent amount of one or more catalyst adjuncts selected from Group IB or Group VIII noble metals. The preferred adjunct catalysts are silver, gold, ruthenium, rhodium, platinum, iridium, or osmium. Most preferred are silver and platinum.

The palladium and any adjunct may be incorporated onto the support in a variety of different methods using palladium complexes, compounds, or dispersions of the metal. The compounds or complexes may be water or hydrocarbon soluble. They may be precipitated from solution. The liquid carrier generally needs only to be removable from the catalyst carrier by volatilization or decomposition while leaving the palladium in a dispersed form on the support. Examples of the palladium complexes and compounds suitable in producing the catalysts used in this invention are palladium chloride, palladium diammine dinitrite, palladium tetrammine chloride, palladium 2-ethylhexanoic acid, sodium palladium chloride, and other palladium salts or complexes.

The adjunct metal (or metals) may be added by including it in the liquid carrier containing the palladium, as a complex, compound, or metallic dispersion of the catalyst adjunct. For instance, silver may be added as silver nitrate or silver acetate, or silver organic complexes. The catalyst adjunct metal may alternatively be added in a separate step after or before the palladium is deposited on the support although the mixing of the adjunct with the palladium on the support appears to be less complete if the adjunct is added separately. The adjunct should be added in an amount such that the mole ratio of adjunct to palladium is 0.2 to 0.9.

Other support materials such as ceramics and the various inorganic oxides typically used as supports e.g. silica, alumina, silica-alumina, titania, zirconia, etc., may be used with or without additions such as barium, cerium, lanthanum, or chromium added for stability.

Metallic supports in the form of honeycombs, spiral rolls of corrugated sheet (which may be interspersed with flat separator sheets), columnar (or "handful of straws"), or other configurations having longitudinal channels or passageways permitting high space velocities with a minimal pressure drop are desirable in this service. They are malleable, can be mounted and attached to surrounding structures more readily, and offer lower flow resistance due to the thinner walls than can be readily manufactured in ceramic supports. Another practical benefit attributable to metallic supports is the ability to survive thermal shock. Such thermal shocks occur in gas turbine operations when the turbine is started and stopped and, in particular, when the turbine must be rapidly shut down. In this latter case, the fuel is cut off or the turbine is "tripped" because the physical load on the turbine—e.g., a generator set—has been removed. Fuel to the turbine is immediately cut off to prevent overspeeding. The temperature in the combustion chambers, where the inventive process takes place, quickly drops from the temperature of combustion to the temperature of the compressed air. This drop could span more than 1000° C. in less than one second. In any event, the catalyst is deposited, or otherwise placed, on the walls within the channels or passageways of the metal support in the amounts specified above. The catalyst may be introduced onto the support in a variety of formats: the complete support may be covered, the downstream portion of the support may be covered, or one side of the support's wall may be covered to create an integral heat exchange relationship such as that discussed with regard to the later stages below. The preferred configuration is complete coverage because of the desire for high overall activity at low temperatures but each of the others may be of special use under specific circumstances. Several types of support materials are satisfactory in this service: aluminum, aluminum containing or aluminum-treated steels, and certain stainless steels or any high temperature metal alloy, including nickel or cobalt alloys where a catalyst layer can be deposited on the metal surface.

The preferred materials are aluminum-containing steels such as those found in U.S. Pat. Nos. 4,414,023 to Aggen et al., 4,331,631 to Chapman et al., and 3,969,082 to Cairns, et al. These steels, as well as others sold by Kawasaki Steel Corporation (River Lite 20-5 SR), Vereinigte Deutchse Metallwerke AG (Alumchrom I RE), and Allegheny Ludlum Steel (Alfa-IV) contain sufficient dissolved aluminum so that, when oxidized, the aluminum forms alumina whiskers or crystals on the steel's surface to provide a rough and chemically reactive surface for better adherence of the washcoat.

The washcoat may be applied using an approach such as is described in the art, e.g., the application of gamma-alumina sols or sols of mixed oxides containing aluminum, silicon, titanium, zirconium, and additives such as barium, cerium, lanthanum, chromium, or a variety of other components. For better adhesion of the washcoat, a primer layer may be applied containing hydrous oxides such as a dilute suspension of pseudo-boehmite alumina as described in U.S. Pat. No. 4,279,782 to Chapman et al. Desirably, however, the primed surface is then coated with a zirconia suspension, dried, and calcined to form a high surface area adherent oxide layer on the metal surface.

The washcoat may be applied in the same fashion one would apply paint to a surface, e.g., by spraying, direct application, dipping the support into the washcoat material, etc.

Aluminum structures are also suitable for use in this invention and may be treated or coated in essentially the same manner. Aluminum alloys are somewhat more ductile and likely to deform or even to melt in the temperature operating envelope of the process. Consequently, they are less desirable supports but may be used if the temperature criteria can be met.

Once the washcoat and palladium have been applied to the metallic support and calcined, one or more coatings of a low or non-catalytic oxide may then be applied as a diffusion barrier to prevent the temperature "runaway" discussed above. This barrier layer can be alumina, silica, zirconia, titania, or a variety of other oxides with a low catalytic activity for combustion of the fuel or mixed oxides or oxides plus additives similar to those described for the washcoat layer. Alumina is the least desirable of the noted materials. The barrier layer can range in thickness from 1% of the washcoat layer thickness to a thickness substantially thicker than the washcoat layer, but preferably from 10% to 100% of the washcoat layer thickness. The preferred thickness will depend on the operating conditions of the catalyst, including the fuel type, the gas flow velocity, the preheat temperature, and the catalytic activity of the washcoat layer. It has also been found that the application of the diffusion barrier coating only to a downstream portion of the catalyst structure, e.g., 30% to the length, can provide sufficient protection for the catalyst under certain conditions. As with the washcoat, the barrier layer or layers may be applied using the same application techniques one would use in the application of paint.

This catalyst structure should be made in such a size and configuration that the average linear velocity through the channels in the catalyst structure is greater than about 0.2 m/second and no more than about 40 m/second throughout the first catalytic zone structure. This lower limit is an amount larger than the flame front speed for methane and the upper limit is a practical one for the type of supports currently commercially available. These average velocities may be somewhat different for fuels other than methane.

The first catalytic zone is sized so that the bulk outlet temperature of the gas from that zone is no more than about 800° C., preferably in the range of 450° C. to 700° C. and, most preferably, 500° C. to 650° C.

Second Catalytic Zone

The second zone in the process takes partially combusted gas from the first zone and causes further controlled combustion to take place in the presence of a catalyst structure having heat exchange capabilities and desirably comprising a Group VIII noble metal or a metal-oxygen catalytic material. The metal-oxygen material desirably contains one or more metals selected from those found in Mendelev Group VIII and Group I. The Group VIII noble metals are palladium, platinum, rhodium, ruthenium, osmium, and iridium. Most preferred are the metal-oxygen catalytic materials, platinum, and palladium. These materials are desirable because of their relative stability at higher temperatures. The catalyst preferably contains palladium and, optionally, may contain up to an equivalent amount of one or more catalyst adjuncts selected from Group IB or Group VIII noble metals. The preferred adjunct catalysts are silver, gold, ruthenium, rhodium, platinum, iridium, or osmium. Most preferred adjuncts are silver and platinum. This zone may operate adiabatically with the heat generated in the partial combustion of the fuel resulting in a rise in the gas temperature. Neither air nor fuel is added between the first and second catalytic zone.

The catalyst structure in this zone is similar to that used in the first catalytic zone except that the catalyst preferably is applied to at least a portion of only one side of the surface forming the walls of the monolithic catalyst support structure. FIG. 2A shows a cutaway of a the high surface area metal oxide washcoat (10), and active metal catalyst (12) applied to one side of the metal substrate (14). This structure readily conducts the reaction heat generated at the catalyst (12) through the interface between the washcoat layer (10) and gas flow (16) in FIG. 2B. Due to the relatively thermal high conductivity of the washcoat (10) and metal (14), the heat is conducted equally along pathway (A) as well as (B), dissipating the reaction heat equally into flowing gas streams (16) and (18). This integral heat exchange structure will have a substrate or wall temperature given by equation (1):

$$T_{wall} = \frac{T_{gas\ inlet} + T_{adiabatic}}{2} \quad (1)$$

The wall temperature rise will be equal to about half the difference between the inlet temperature and the theoretical adiabatic combustion temperature.

Metal sheets coated on one side with catalyst, and the other surface being non-catalytic, can be formed into rolled or layered structures combining corrugated (20) and flat sheets (22) as shown in FIGS. 3A through 3C to form long open channel structures offering low resistance to gas flow. A corrugated metal strip (30) coated on one side with catalyst (32) can be combined with a separator strip (34) not having a catalytic coating to form the structure shown in FIG. 4A.

Figure 4A:
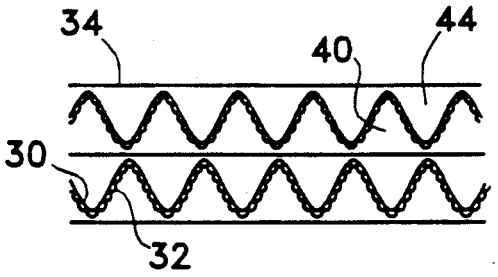
Figure 4B:
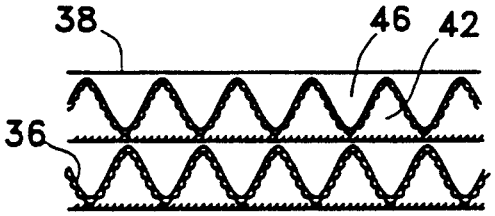

Alternatively, corrugated (36) and flat strips (38) both coated with catalyst on one side prior to assembly into a catalyst structure can be combined as shown in FIG. 4B. The structures form channels with catalytic walls (40 in FIG. 4A and 42 in FIG. 4B) and channels with non-catalytic walls (44 in FIG. 4A and 46 in FIG. 4B). Catalytic structures arranged in this manner with catalytic channels and separate non-catalytic channels (limited-integral-heat-exchange structures "L-IHE"), are described in co-pending application Ser. No. 07/617,974. These structure have the unique ability to limit the catalyst substrate temperature and outlet gas temperature.

Figure 5:
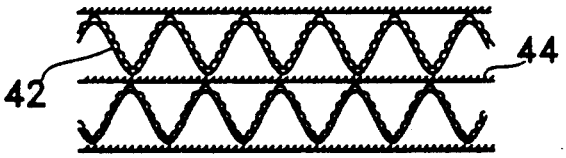

The corrugated (42) and flat sheets (44) coated on one side with catalyst can be arranged according to FIG. 5 where the catalytic surface of each sheet faces a different channel so that all channels have a portion of their walls' catalyst coated and all walls have one surface coated with catalyst and the opposite surface non-catalytic. The FIG. 5 structure will behave differently from the FIG. 4A and FIG. 4B structures. The walls of the FIG. 5 structure form an integral heat exchange but, since all channels contain catalyst, there is then a potential for all the fuel to be catalytically combusted. As combustion occurs at the catalyst surface, the temperature of the catalyst and support will rise and the heat will be conducted and dissipated in the gas flow on both the catalytic side and the non-catalytic side. This will help to limit the temperature of the catalyst substrate and will aid the palladium temperature limiting to maintain the wall temperature at 750° C. to 800° C. at one atm of air or about 930° C. at ten atm of air. For sufficiently long catalysts or low gas velocities, a constant outlet gas temperature of 750° C. to 800° C. would be obtained for any fuel/air ratio with an adiabatic combustion temperature above approximately 800° C. at one atm of air or about 930° C. at ten atm of air.

The structures shown in FIGS. 4A and 4B have equal gas flow through each of the catalytic channels and non-catalytic channels. The maximum gas temperature rise with these structures will be that produced by 50% combustion of the inlet fuel.

Figure 6A:
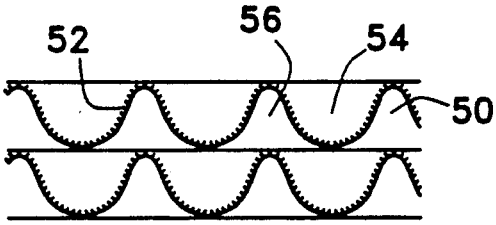
Figure 6B:
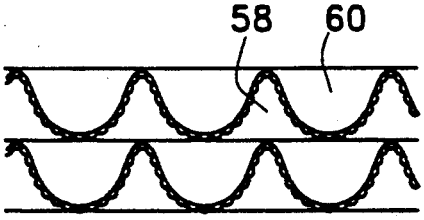

The structures shown in FIGS. 4A and 4B may be modified to control the fraction of fuel and oxygen reacted by varying the fraction of the fuel and oxygen mixture that passes through catalytic and non-catalytic channels. FIG. 6A shows a structure where the corrugated foil has a structure with alternating narrow (50) and broad (52) corrugations. Coating this corrugated foil on one side results in a large catalytic channel (54) and a small non-catalytic channel (56). In this structure approximately 80% of the gas flow would pass through catalytic channels and 20% through the non-catalytic channels. The maximum outlet gas temperature would be about 80% of the temperature rise expected if the gas went to its adiabatic combustion temperature. Conversely, coating the other side of the foil only (FIG. 6B) results in a structure with only 20% of the gas flow through catalytic channels (58) and a maximum outlet gas temperature increase of 20% of the adiabatic combustion temperature rise. Proper design of the corrugation shape and size can achieve any level of conversion from 5% to 95% while incorporating integral heat exchange. The maximum outlet gas temperature can be calculated by equation 2 below:

$$T_{gas\ max} = T_{gas\ inlet} + [T_{adiabatic} - T_{gas\ inlet}] \times \frac{\text{catalytic gas flow}}{\text{non-catalytic gas flow}} \quad (2)$$

To illustrate the operation of this integral heat exchange zone, assume that a partially combusted gas from the first catalytic zone flows into the FIG. 4A structure in which the gas flow through the catalytic channels is 50% of the total flow.

Approximately half of the gas flow will pass through channels with catalytic walls (42) and half will flow through channels with non-catalytic walls (46). Fuel combustion will occur at the catalytic surface and heat will be dissipated to the gas flowing in both the catalytic and non-catalytic channels. If the gas from zone (1) is 500° C. and the fuel/air ratio corresponds to a theoretical adiabatic combustion temperature of 1300° C., then combustion of the fuel in the catalytic channels will cause the temperature of all of the flowing gases to rise. The heat is dissipated into gas flowing in both the catalytic and non-catalytic channels. The calculated L-IHE wall temperature is:

$$T_{wall} = \frac{500°\ C. + 1300°\ C.}{2} = 900°\ C.$$

The calculated maximum gas temperature is:

$$T_{gas\ max} = 500°\ C. + [1300°\ C. - 500°\ C.] \times 0.5 = 900°\ C.$$

However, the palladium at one atm of air pressure will limit the wall temperature to 750° C. to 800° C. and the maximum outlet gas temperature will be about <800° C. As can be seen in this case, the palladium limiting is controlling the maximum outlet gas temperature and limiting the wall temperature.

The situation is different at ten atmospheres of air pressure. The palladium limiting temperature is about 930° C. The wall will be limited to 900° C. by the L-IHE structure. In this case, the L-IHE structure is limiting the wall and gas temperature. The catalyst structure in this zone should have the same approximate catalyst loading, on those surfaces having catalysts, as does the first zone structure. It should be sized to maintain flow in the same average linear velocity as that first zone and to reach a bulk outlet temperature of no more than 800° C., preferably in the range of 600° C. to 800° C. and most preferably between 700° C. and 800° C. The catalyst can incorporate a non-catalytic diffusion barrier layer such as that described for the first catalytic zone.

As a design matter, therefore, the second catalytic zone should be designed such that the bulk temperature of the gas exiting the zone is above its autoignition temperature (if the homogenous combustion zone is desired). The support and catalyst temperature are maintained at the moderation temperature mandated by the relative sizing of the catalytic and non-catalytic channels, the inlet temperature, the theoretical adiabatic combustion temperature, and the length of the second zone. The linear velocity of the gas in the second catalytic zone is the same as that of the first zone.

Homogeneous Combustion Zone

The gas which has exited the earlier combustion zones may be in a condition suitable for subsequent use if the temperature is correct; the gas contains substantially no $NO_x$ and yet the catalyst and catalyst supports have been maintained at a temperature which permits their long term stability. However, for many uses, a higher temperature is required. For instance, many gas turbines are designed for an inlet temperature of about 1260° C. Consequently, a homogeneous combustion zone may be an appropriate addition. Homogeneous combustion does not entail a catalytic reaction nor flame chemistry.

We have found that as the pressure of operation increases, the temperature at which the palladium catalyst "self-limits" rises and the temperature at which the fuel mixture undergoes homogeneous combustion decreases. At above about ten atmospheres, for most practical fuel/air ratios, the palladium catalyst self-limiting temperature and the homogeneous combustion initiation temperature are equal or are sufficiently compatible that a "hot end" combustion catalyst stage may be eliminated.

The homogeneous combustion zone need not be large. The gas residence time in the zone normally should not be more than about eleven or twelve milliseconds to achieve substantially complete combustion (i.e., <10 ppm CO) and to achieve the adiabatic combustion temperature.

The table below shows calculated residence times both for achievement of various adiabatic combustion temperatures (as a function of fuel/air ratio) as well as achievement of combustion to near completion variously as a function of fuel(methane)/air ratio, temperature of the bulk gas leaving the earlier catalyst zone, and pressure. These reaction times were calculated using a homogeneous combustion model and kinetic rate constants described by Kee et al. (Sandia National Laboratory Report No. SAND 80-8003).

TABLE

Calculated Homogenous Combustion Times as a function of inlet temperature, pressure, and F/A (fuel/air) ratio - Time to $T_{ad}$ and (time to CO < 10 ppm) are in milliseconds>

| | F/A = 0.043 ($T_{ad}$ = 1300° C.) | | F/A = 0.037 ($T_{ad}$ = 1200° C.) | | F/A = 0.032 ($T_{ad}$ = 1100° C.) | |
|---|---|---|---|---|---|---|
| | 1 atm | 10 atm | 1 atm | 10 atm | 1 atm | 10 atm |
| 800° C. | — | 19.7 (21.0) | — | — | — | — |
| 900° C. | — | 3.5 (4.8) | — | 3.3 (6.2) | — | 3.7 (10.2) |
| 1000° C. | 6.5 (14.5) | 1.0 (2.5) | 5.0 (16.0) | 1.0 (3.9) | — | 1.0 (8.1) |
| 1050° C. | 3.6 (11.7) | 0.6 (2.1) | 3.5 (13.5) | 0.6 (3.6) | — | 0.5 (7.7) |
| 1100° C. | 2.5 (10.3) | — | — | — | — | — |

$T_{ad}$ = adiabatic combustion temperature minus 20° C.
F = fuel is methane

Clearly, for a process used in support of a gas turbine, (e.g., catalyst gas bulk exit temperature=900° C., F/A ratio of 0.043, pressure=ten atm.), the residence time to reach the adiabatic combustion temperature and complete combustion is less than five milliseconds. A bulk linear gas velocity of less than 40 meter/sec (as discussed earlier in regard to the catalytic stages) would result in a homogeneous combustion zone of less than 0.2 meters in length.

Additionally, the table shows that practical homogeneous combustion times are available at higher pressures as compared to those at lower pressure. For instance, the combustion time at 900° C. inlet (as might be found in a partially combusted gas exiting a palladium temperature-limited second stage) at an F/A of 0.043 and an operating pressure of ten atm., is 3.5 milliseconds. In sharp contrast, homogeneous combustion does not occur at 1.0 atm.

In summary, the process uses two carefully crafted catalyst structures and catalytic methods to produce a working gas which contains substantially no $NO_x$ and is at a temperature comparable to normal combustion processes. Yet, the catalysts and their supports are not exposed to deleteriously high temperatures which would harm those catalysts or supports or shorten their useful life.

This invention has been shown both by direct description and by example. The examples are not intended to limit the invention as later claimed in any way; they are only examples. Additionally, one having ordinary skill in this art would be able to recognize equivalent ways to practice the invention described in these claims. Those equivalents are considered to be within the spirit of the claimed invention.

We claim as our invention:

1. A process for combusting combustible mixtures comprising the steps of:
   a. mixing an oxygen-containing gas with a fuel at a relatively high pressure to form a high pressure combustible mixture,
   b. contacting the high pressure combustible mixture in a first zone with a first zone combustion catalyst comprising palladium completely covering a catalyst support at reaction conditions sufficient to combust at least a portion but not all of the fuel,
   c. contacting the partially combusted gas from the first zone in a second catalytic zone with a second zone combustion catalyst having heat exchange surfaces comprising a metallic support with walls having palladium catalyst applied to at least a portion of only one side and not the other side of the surface forming the walls of the catalyst support so as to limit the catalyst substrate temperature and bulk outlet gas temperature at reaction conditions sufficient to combust at least a further portion of the fuel and produce a mixture capable of supporting homogeneous combustion.

2. The process of claim 1 wherein the gaseous combustible mixture is introduced into the first zone at a temperature of at least about 325° C.

3. The process of claim 2 wherein the gaseous combustible mixture is introduced into the first zone at a temperature between 325° C. and 375° C.

4. The process of claim 1 wherein the bulk temperature of the gas leaving the first zone is no greater than about 800° C.

5. The process of claim 4 wherein the bulk temperature of the gas leaving the first zone is between about 500° C. and 650° C.

6. The process of claim 1 wherein the second zone combustion catalyst comprises palladium and bulk temperature of the gas leaving the second zone is no greater than about 950° C.

7. The process of claim 5 wherein the bulk temperature of the gas leaving the second zone is between about 750° C. and 950° C.

8. The process of claim 1 wherein the oxygen-containing gas is air and is compressed to a pressure of at least four to five atmospheres (guage).

9. The process of claim 5 wherein the first zone combustion catalyst comprises palladium on a metallic support.

10. The process of claim 9 wherein the first zone combustion catalyst comprising palladium on a metallic support additionally comprises a barrier layer covering at least a portion of the palladium.

11. The process of claim 10 wherein the barrier layer comprises zirconia.

12. The process of claim 1 additionally comprising the step of combusting any remaining uncombusted fuel in a third non-catalytic zone using homogenous combustion to produce a gas having a temperature greater than that of the gas leaving the second zone but no greater than about 1700° C.

13. The process of claim 7 additionally comprising the step of combusting any remaining uncombusted fluid fuel in a third non-catalytic zone using homogeneous combustion to produce a gas having a temperature greater than that of the gas leaving the second zone but no greater than about 1700° C.

14. A process for combusting combustible mixtures to produce a low $NO_x$ gas comprising the steps of:

a. contacting a combustible mixture of a fuel and air at a pressure greater than four to five atmospheres in a first zone with a first zone combustion catalyst comprising palladium completely covering a metallic support at reaction conditions sufficient to combust at least a portion but not all of the fluid fuel and produce a partially combusted gas at a bulk and localized temperature no greater than about 800° C., and b. contacting the partially combusted gas from the first zone in a second catalytic zone with a second zone combustion catalyst comprising palladium on a support structure having integral heat exchange surfaces comprising a metallic support with walls having the catalyst applied to at least a portion of only one side and not the other side of the surface forming the walls of the catalyst support structure so as to limit the catalyst substrate temperature and bulk outlet gas temperature at reaction conditions sufficient to combust at least a portion but not all of the fluid fuel and produce a partially combusted gas at a bulk temperature greater than the bulk temperature of the gas leaving the first zone but no greater than about 950° C. but capable of supporting homogenous combustion.

15. The process of claim 14 wherein the gaseous combustible mixture is introduced into the first zone at a temperature of at least about 325° C.

16. The process of claim 15 wherein the gaseous combustible mixture is introduced into the first zone at a temperature between 325° C. and 375° C.

17. The process of claim 14 wherein the bulk temperature of the gas leaving the first zone is no greater than about 550° C.

18. The process of claim 17 wherein the bulk temperature of the gas leaving the first zone is between about 500° C. and 600° C.

19. The process of claim 14 wherein the bulk temperature of the gas leaving the second zone is no greater than about 800° C.

20. The process of claim 16 wherein the bulk temperature of the gas leaving the second zone is between about 700° C. and 850° C.

21. The process of claim 14 wherein the first zone combustion catalyst comprising palladium on a metallic support additionally comprises an oxide barrier layer covering at least a portion of the palladium.

22. The process of claim 21 wherein the barrier comprises zirconia.

23. The process of claim 19 additionally comprising the step of combusting any remaining uncombusted fluid fuel in a third non catalytic zone to produce a gas having a temperature greater than that of the gas leaving the second zone but no greater than about 1700° C.

24. The process of claim 20 additionally comprising the step of combusting any remaining uncombusted fluid fuel in a third non catalytic zone to produce a gas having a temperature greater than that of the gas leaving the second zone but no greater than about 1700° C. using homogenous combustion.

25. A process for combusting combustible mixtures to produce a low $NO_x$ gas comprising the steps of:

a. mixing methane and air at a pressure greater than about four to five atmospheres to produce a high pressure mixture, b. contacting the high pressure mixture in a first zone with a first zone combustion catalyst comprising palladium completely covering a metallic support at reaction conditions sufficient to combust at least a portion but not all of the methane and produce a partially combusted gas at a bulk and localized temperatures no greater than about 800° C., c. contacting the partially combusted gas from the first zone in a second catalytic zone with a second zone combustion catalyst comprising palladium on a support structure having integral heat exchange surfaces comprising a metallic support with walls having the catalyst applied to at least a portion of only one side and not the other side of the surface forming the walls of the catalyst support structure so as to limit the catalyst substrate temperature and bulk outlet gas temperature at reaction conditions sufficient to combust at least a portion but not all of the methane and produce a partially combusted gas at a bulk temperature greater than the bulk temperature of the gas leaving the first zone but no greater than about 950° C. but capable of supporting homogenous combustion.

26. The process of claim 25 wherein the gas from the second zone contains uncombusted methane and additionally comprising the steps of combusting the remaining uncombusted methane in a third non catalytic zone to produce a combusted gas having a bulk temperature higher than the temperature of the gas leaving the second zone but no greater than about 1700° C. but capable of supporting homogenous combustion:

27. The processes of claim 26 wherein the low $NO_x$ gas has no more than about 5 ppm $NO_x$.

* * * * *